US007474278B2

(12) United States Patent
Kim et al.

(10) Patent No.: US 7,474,278 B2
(45) Date of Patent: Jan. 6, 2009

(54) PLASMA DISPLAY APPARATUS AND METHOD OF DRIVING THE SAME

(75) Inventors: Muk Hee Kim, Daegu-si (KR); Yun Kwon Jung, Gumi-si (KR); Byung Hyun Kim, Gumi-si (KR); Myung Soo Ham, Busan-si (KR)

(73) Assignee: LG Electronics Inc., Seoul (KR)

( * ) Notice: Subject to any disclaimer, the term of this patent is extended or adjusted under 35 U.S.C. 154(b) by 58 days.

(21) Appl. No.: 11/368,403

(22) Filed: Mar. 7, 2006

(65) Prior Publication Data

US 2007/0013615 A1 Jan. 18, 2007

(30) Foreign Application Priority Data

Jul. 16, 2005 (KR) ..... 10-2005-0064560

(51) Int. Cl.
*G09G 5/00* (2006.01)

(52) U.S. Cl. ..... 345/60; 345/62; 345/204

(58) Field of Classification Search ..... 315/169.4, 315/169.1; 345/60–72, 204–213
See application file for complete search history.

(56) References Cited

U.S. PATENT DOCUMENTS 6,906,690 B2 * 6/2005 Lim ..... 345/60
2004/0125096 A1 * 7/2004 Kigo et al. ..... 345/204
2004/0130509 A1 7/2004 Yoon et al. ..... 345/63
2004/0257306 A1 12/2004 Choi ..... 345/60
2005/0264481 A1 * 12/2005 Choi et al. ..... 345/63
2006/0109207 A1 * 5/2006 Jung et al. ..... 345/67
2007/0097051 A1 * 5/2007 Kang et al. ..... 345/89
2007/0115218 A1 * 5/2007 Lim ..... 345/67

OTHER PUBLICATIONS

European Search Report dated Sep. 18, 2006.

* cited by examiner

*Primary Examiner*—David Hung Vu
(74) *Attorney, Agent, or Firm*—KED & Associates, LLP

(57) ABSTRACT

A plasma display apparatus is provided. The plasma display apparatus comprises an energy recovery unit and a sustain driver for applying a voltage recovered from the energy recovery unit to sustain electrodes as a bias voltage in an address period. The voltage recovered to a source capacitor is applied as the bias voltage in the address period so that it is possible to apply the bias voltage that varies in accordance with the sustain voltage of a plasma display panel without an additional external power source. As a result, it is possible to reduce the manufacturing expenses of the plasma display apparatus.

21 Claims, 6 Drawing Sheets

PLASMA DISPLAY APPARATUS AND METHOD OF DRIVING THE SAME

BACKGROUND OF THE INVENTION

1. Field of the Invention

The present invention relates to a plasma display apparatus and a method of driving the same, and more particularly, to a plasma display apparatus for controlling on/off of a switch comprised in an energy recovery unit for recovering a voltage from a panel capacitor to supply the voltage again to apply a bias voltage for an address period and a method of driving the same.

2. Description of the Background Art

In general, a plasma display panel (PDP) emits light from a phosphor by vacuum ultraviolet (UV) rays generated when a gas such as He+Xe, Ne+Xe, or He+Ne+Xe is discharged to display an image.

FIG. 1 is a perspective view illustrating the structure of a conventional PDP.

First, scan electrodes 1 and sustain electrodes 2, a dielectric layer 13 that covers the scan electrodes 1 and the sustain electrodes 2, and a protective layer 14 that covers the dielectric layer 13 are formed on a front substrate A that forms the PDP.

The scan electrodes 1 and the sustain electrodes 2 are composed of transparent electrodes 1*a* and 2*a* formed of transparent electrode material (ITO) so that visible rays are transmitted to the front of the PDP and metal bus electrodes 1*b* and 2*b* for compensating for the surface resistance of the transparent electrodes 1*a* and 2*a*.

Address electrodes 6 are formed to intersect the scan electrodes 1 and the sustain electrodes 2 and a dielectric layer 8 that covers the address electrodes 6 is formed in the rear substrate B.

Barrier ribs 7 for partitioning discharge spaces are formed in the dielectric layer 8 and a phosphor 9 excited by the UV rays to emit light is formed on the side of the barrier ribs 7 and on the dielectric layer 8 to emit one of red, green, and blue visible rays.

The PDP having the above-described structure is driven so that one frame is divided into a plurality of sub-fields having different number of times of emission. For example, when an image is displayed by 256 gray levels, one frame corresponding to 1/60 second is divided into 8 sub-fields and each sub-field is divided into a reset period R for initializing a discharge cell, an address period A for selecting a discharge cell, and a sustain period S for realizing gray levels in accordance with the number of times of discharge.

FIG. 2 illustrates driving waveforms supplied to the conventional PDP. As illustrated in FIG. 2, the sub-field illustrated in FIG. 2 is divided into the reset period R, the address period A, and the sustain period S.

In the reset period R, a set-up signal R_up that rises in the form of a ramp is applied to the scan electrodes Y so that wall charges are accumulated in the discharge cell and a set-down signal R_dn that falls to a negative specific voltage level in the form of a ramp is applied so that some of the wall charges excessively formed in the discharge cell is erased.

In the address period A, a scan pulse scp that sustains a scan bias voltage to fall to a negative voltage level is applied. At this time, a data pulse dp that rises to a positive voltage level is applied to the address electrodes X in synchronization with the scan pulse scp. An address discharge is generated by difference in voltage between the scan pulse scp applied to the scan electrodes Y and the data pulse dp applied to the address electrodes X.

In the sustain period S, sustain pulses having a sustain voltage Vs level are alternately applied to the scan electrodes Y and the sustain electrodes Z so that a sustain discharge is generated.

As illustrated in FIG. 2, a positive bias voltage Vzb smaller than the sustain voltage Vs is applied to the sustain electrodes Z in the period where the set-down signal R-dn is applied to the scan electrodes Y and the address period A to reduce difference in voltage between the scan electrodes Y and the sustain electrodes Z so that erroneous discharge is not generated.

In order to apply the positive bias voltage Vzb having such a voltage level, the sustain driving circuit illustrated in FIG. 3 is comprised.

The conventional sustain driving circuit comprises an external voltage source Vzb for supplying the bias voltage Vzb and a switching device Fzb connected to the external voltage source so that electricity flows through the switching device Fzb by the control of a timing controller, the switching device Fzb for applying the bias voltage to the sustain electrodes.

The sustain driving circuit comprises an energy recovery unit 10 for recovering the energy stored in a panel capacitor Cp to supply the energy for the sustain period S and a sustain signal applying unit 20 for supplying the sustain pulses for the sustain period S.

At this time, electricity flows through the switching device Fzb when the set-down signal R_dn starts to be applied to the scan electrodes Y so that the bias voltage Vzb is applied and flow of electricity to the switching device Fzb is stopped when the address period A is terminated so that the application of the bias voltage is stopped.

Therefore, in order to apply the bias voltage Vzb in the period where the set-down signal R_dn is applied and in the address period A, the conventional sustain driving circuit must comprise the additional external voltage source Vzb and the switching device Fzb for applying the bias voltage. As a result, the circuit becomes complicated and manufacturing expenses thereof increase.

SUMMARY OF THE INVENTION

Accordingly, an object of the present invention is to solve at least the problems and disadvantages of the background art.

It is an object of the present invention to provide a plasma display apparatus comprising a plasma display panel comprising at least one electrodes and a sustain driver for applying a voltage recovered from the plasma display panel in a sustain period as a bias voltage in an address period of a next sub-field.

At this time, the bias voltage is actually about half of a sustain voltage level.

The sustain driver comprises a sustain signal applying unit for applying signals in a sustain period and an energy recovery unit for recovering a voltage from a plasma display panel in the sustain period to apply the recovered voltage as a bias voltage in an address period.

Also, the energy recovery unit comprises an inductor for forming LC resonance together with a panel capacitor in a sustain period, a first switch for supplying a voltage recovered in the sustain period to the panel capacitor, a second switch for recovering a voltage from the panel capacitor, and a source capacitor in which the voltage recovered by LC resonance is stored.

The energy recovery unit makes electricity flow through the first switch in an address period so that a voltage recovered in a sustain period is supplied as a bias voltage in a set-down period and an address period of a next sub-field.

The energy recovery unit makes electricity flow through the first switch and the second switch in an address period so that a voltage recovered in a sustain period is supplied as a bias voltage in the set-down period and the address period of the next sub-field.

At this time, a path in which a voltage is recovered to the energy recovery unit in a sustain period is referred to as a first path and a path in which the voltage recovered through the first path is supplied as a bias voltage in an address period is referred to as a second path Also, a path forming device through which electricity flows so that the bias voltage is applied in the set-down period and the address period and through which electricity does not flow in the other periods than the set-down period and the address period is connected to the second path. The path forming device is formed of a switch device such as a field effect transistor (FET) and an insulated gate bipolar transistor (IGBT).

A method of driving a plasma display apparatus comprises the steps of recovering a voltage from a plasma display panel in a sustain period without comprising an additional external voltage source for a bias voltage in a sustain driving circuit and applying the recovered voltage as a bias voltage of sustain electrodes in an address period after the sustain period.

BRIEF DESCRIPTION OF THE DRAWINGS

The present invention will be described in detail with reference to the following drawings in which like numerals refer to like elements.

DETAILED DESCRIPTION OF PREFERRED EMBODIMENTS

Figure 1:
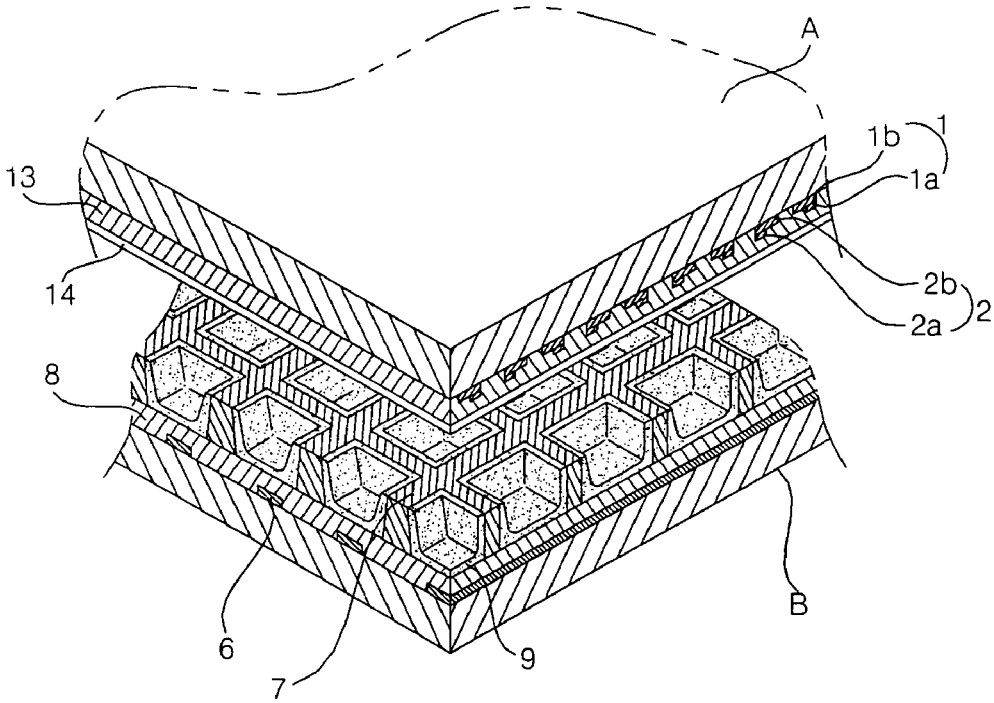
FIG. 1 (related art)
FIG. 1 illustrates the structure of a conventional plasma display panel (PDP).
Figure 2:
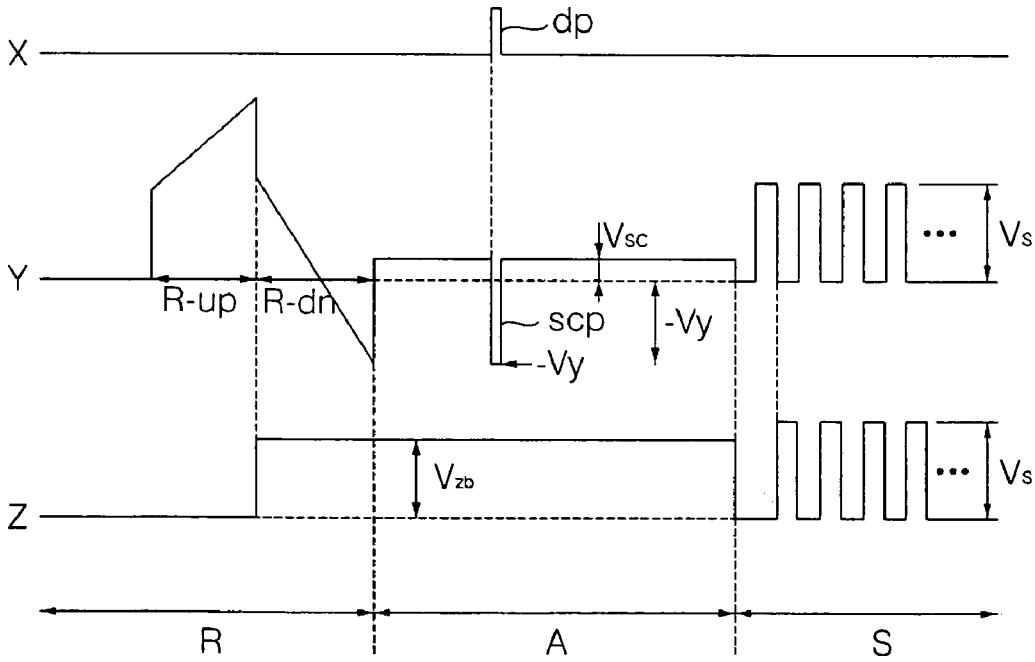
FIG. 2 (related art)
FIG. 2 illustrates driving waveforms applied to the conventional PDP.
Figure 3:
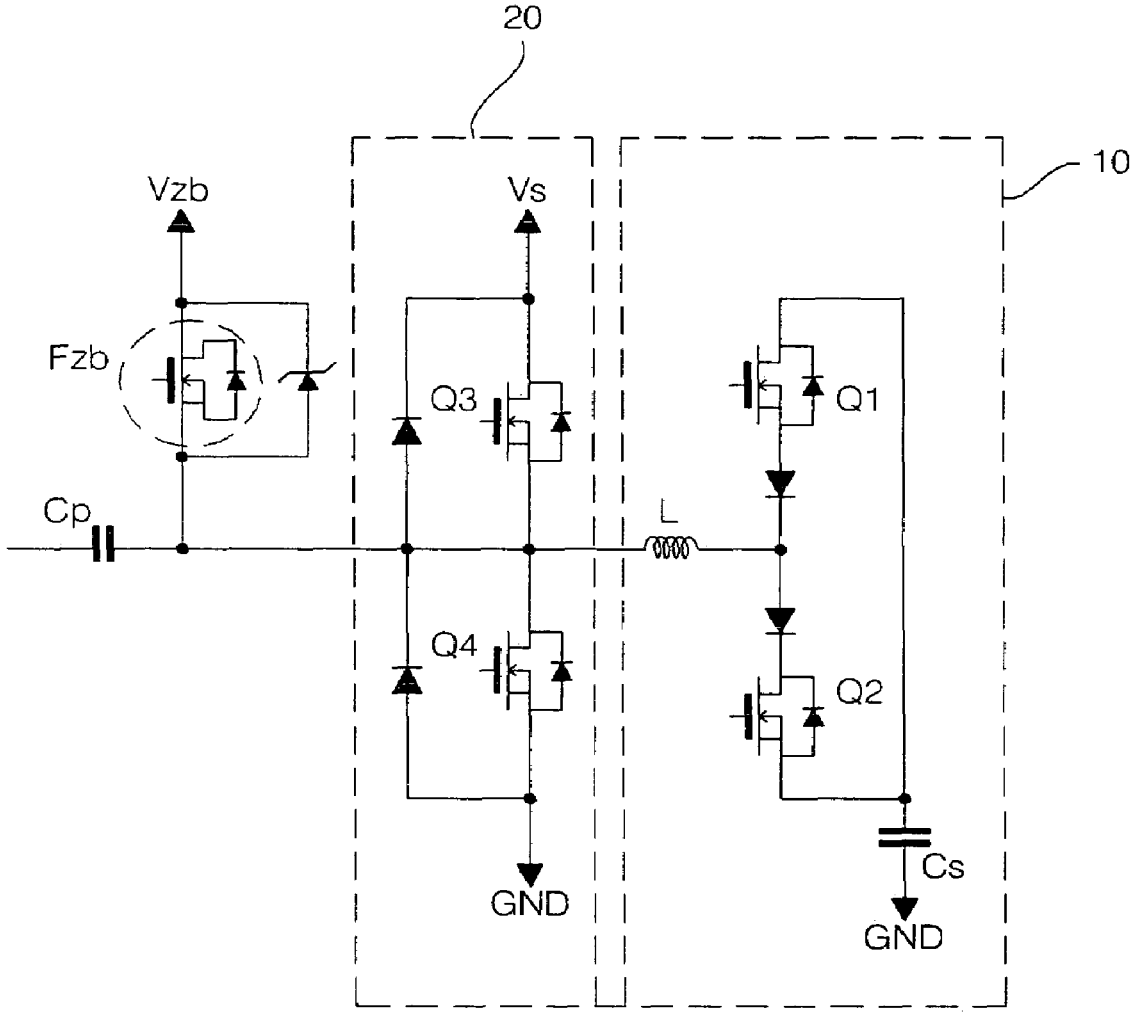
FIG. 3 (related art)
FIG. 3 is a sustain driving circuit diagram of the conventional PDP.

A sustain driving circuit and a plasma display panel (PDP) driven by the sustain driving circuit according to preferred embodiments of the present invention will be described in a more detailed manner with reference to the drawings.

Preferred embodiments of the PDP according to the present invention may be plural and are not limited to the embodiments described in the specification.

Hereinafter, a first embodiment and a second embodiment of a sustain driving circuit of a plasma display apparatus according to the present invention will be described with reference to FIGS. 4A and 4B. The structure of the sustain driving circuit according to the present invention is simpler than the structure of a conventional sustain driving circuit since an external voltage source for applying a bias voltage Vzb is omitted.

An energy recovery unit 30 comprises a source capacitor Cs for storing the energy recovered from a panel capacitor Cp, an inductor L for forming resonance current, and a first switch Q1 and a second switch Q2 connected in parallel between the source capacitor Cs and the inductor L.

When electricity flows through the first switch Q1 in a sustain period S, the energy stored in the panel capacitor Cp is recovered to the source capacitor Cs. When electricity flows through the second switch Q2 in the sustain period S, the energy recovered to the source capacitor Cs is supplied to the panel capacitor.

That is, when electricity flows through the first switch Q1, a first current path I1 that connects the source capacitor Cs, the first switch Q1, the inductor L, and the panel capacitor Cp to each other is formed and the inductor L and the panel capacitor Cp form a serial resonance circuit. Therefore, the voltage of the panel capacitor Cp increases by a voltage level that doubles the voltage charged in the source capacitor Cs.

When electricity flows through the second switch Q2, a current path that connects the panel capacitor Cp, the inductor L, the second switch Q2, and the source capacitor Cs to each other is formed so that the energy accumulated in the panel capacitor Cp is recovered to the source capacitor Cs. Therefore, a voltage Vs/2 corresponding to half of a sustain voltage Vs is charged in the source capacitor Cs.

A sustain signal applying unit 40 for supplying a sustain pulse that rises to the sustain maximum voltage level Vs and then, falls to a ground voltage level GND in the sustain period S is connected between the inductor L and the panel capacitor Cp.

The sustain signal applying unit 40 comprises a third switch Q3 and a fourth switch Q4 connected in parallel between the panel capacitor Cp and the inductor L.

After a voltage is supplied by the energy recovery unit 30 to the panel capacitor Cp in the sustain period S, electricity flows through the third switch Q3 so that the sustain voltage Vs is supplied. That is, a ripple voltage generated by the resonance of the energy recovery unit 30 is sustained as the sustain voltage level Vs.

Also, electricity flows through the fourth switch Q4 so that the voltage of the panel capacitor Cp falls to the ground voltage level GND.

Figure 5A:
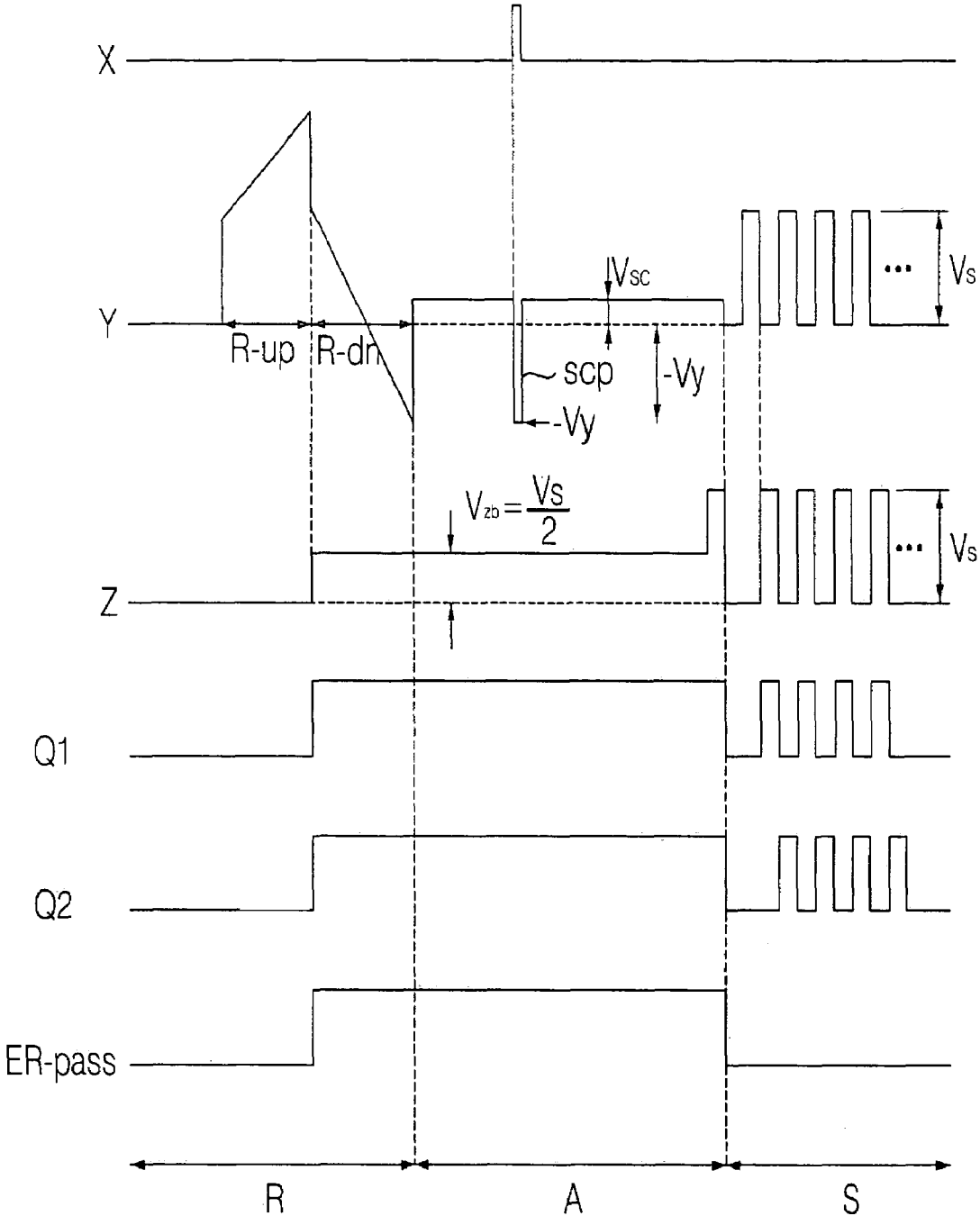
FIG. 5A illustrates driving waveforms of a PDP according to a first embodiment of the present invention.

Electricity flows through the first switch Q1 comprised in the energy recovery unit 30 according to the present invention by a timing controller in a period where a set-down signal R-dn is applied and in an address period A as illustrated in FIG. 5A so that the voltage stored in the source capacitor Cs is supplied as the bias voltage Vzb of sustain electrodes Z in the sustain period S.

Also, electricity simultaneously flows through the first switch Q1 and the second switch Q2 comprised in the energy recovery unit 30 so that the voltage stored in the source capacitor Cs is supplied as the bias voltage of the sustain electrodes Z.

That is, when electricity flows through the first switch Q1 and the second switch Q2, in the case where the voltage stored in the source capacitor Cs is supplied as the bias voltage Vzb by the first switch Q1 and peak noise is instantaneously generated on the first current path I1, the noise component is recovered to the source capacitor Cs through the second switch Q2 so that the stable bias voltage Vzb is applied to the sustain electrodes Z.

At this time, since the voltage recovered from the source capacitor Cs in the sustain period S is about half Vs/2 of the sustain voltage, the bias voltage Vzb about half Vs/2 of the sustain voltage is applied in the period where the set-down signal is applied and in the address period.

Figure 5B:
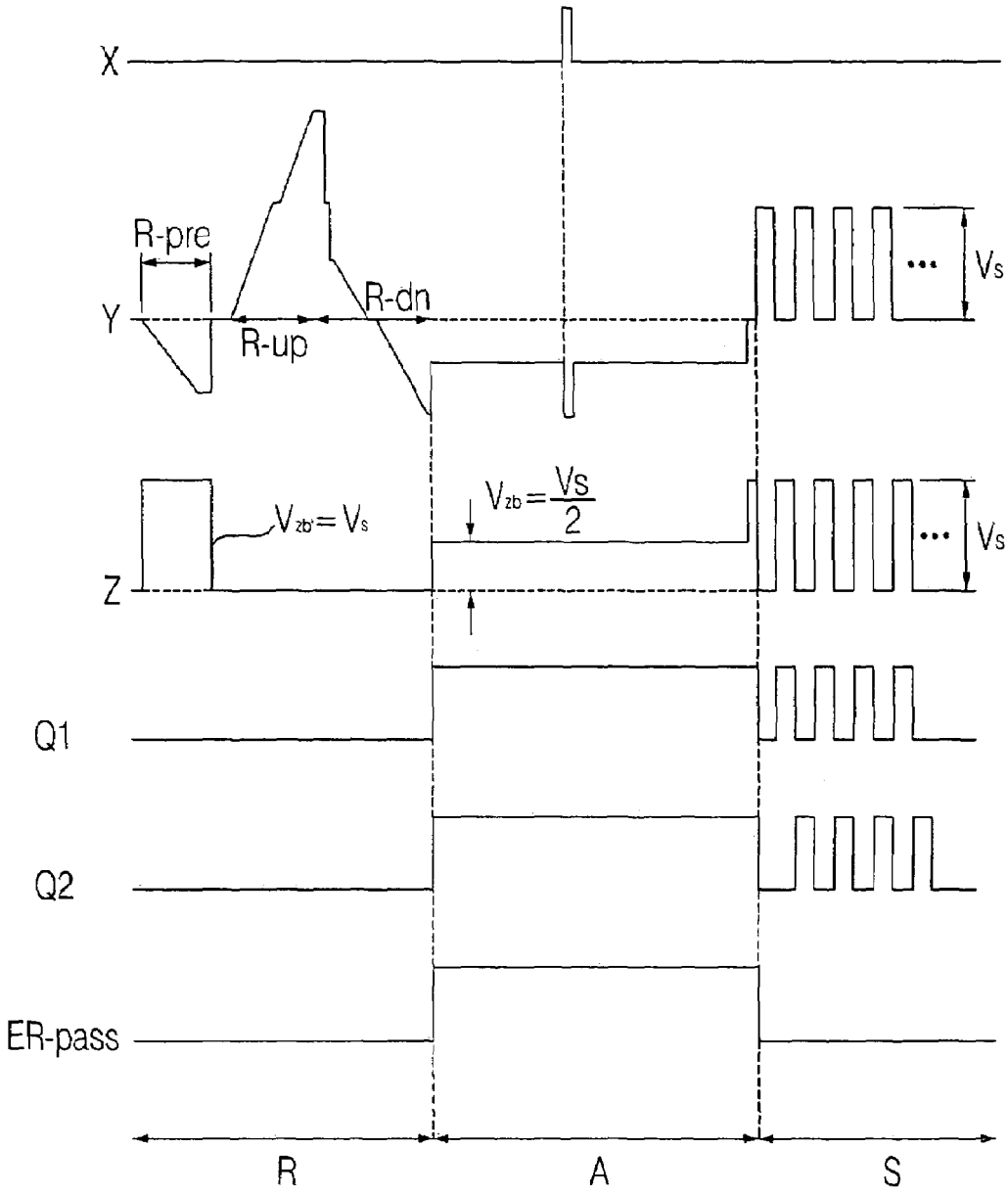
FIG. 5B illustrates driving waveforms of a PDP according to a second embodiment of the present invention.

Electricity flows through the first switch Q1 comprised in the energy recovery unit 30 according to the present invention only in the address period A as illustrated in FIG. 5B so that the voltage stored in the source capacitor Cs is supplied as the bias voltage Vzb of the sustain electrodes Z.

When electricity simultaneously flows through the first switch Q1 and the second switch Q2, in the case where the voltage stored in the source capacitor Cs is supplied as the bias voltage Vzb by the first switch Q1 and peak noise is instantaneously generated on the first current path I1 by the second switch Q2, the noise component is recovered to the source capacitor Cs so that the stable bias voltage Vzb is applied to the sustain electrodes Z.

At this time, since the voltage recovered from the source capacitor Cs in the sustain period S is about half Vs/2 of the sustain voltage, the bias voltage Vzb about half Vs/2 of the sustain voltage is applied only in the address period A.

Figure 4A:
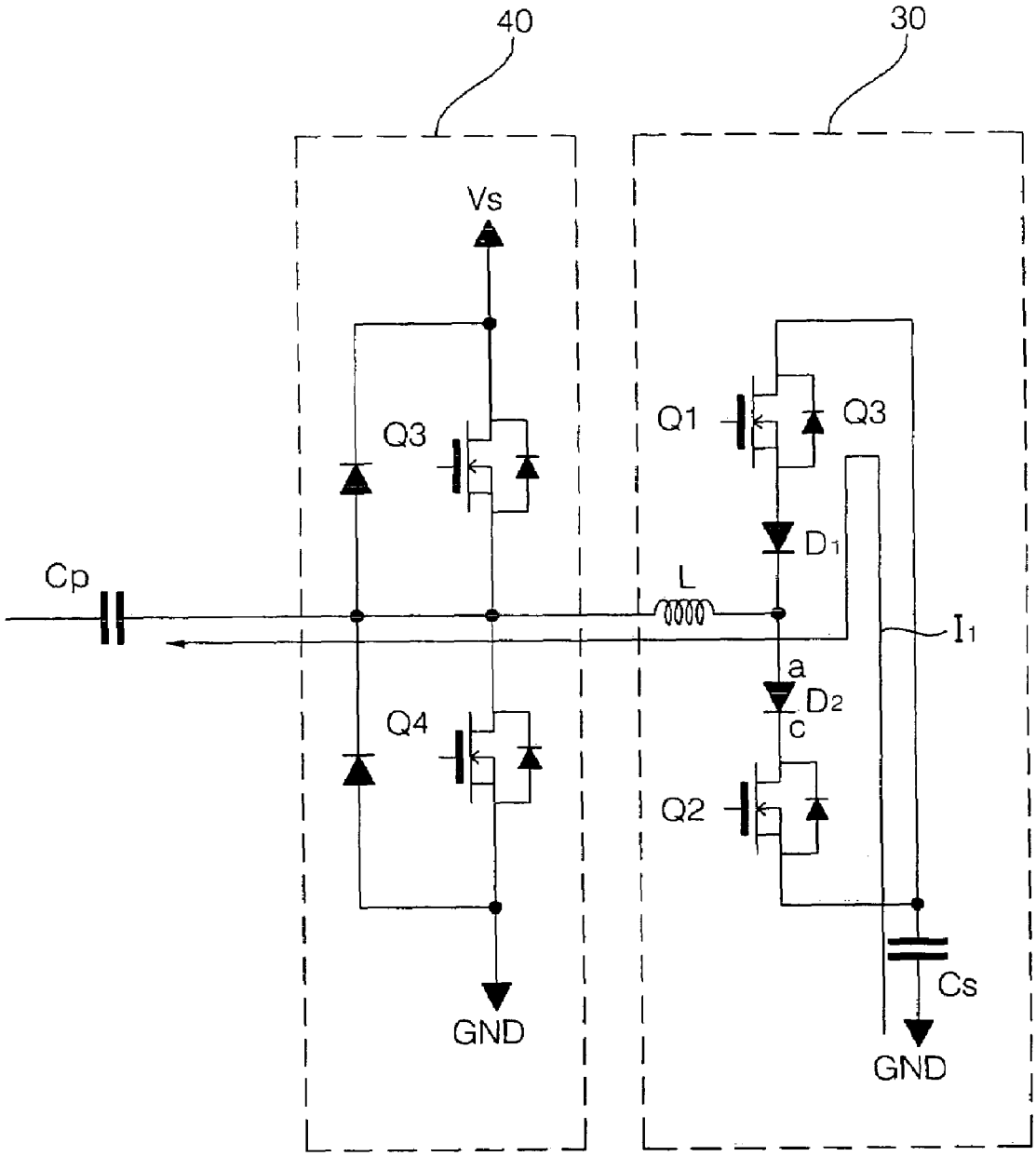
FIG. 4A illustrates a sustain driving circuit according to a first embodiment of the present invention.

As described above, the sustain driver according to the first embodiment illustrated in FIG. 4A can apply the bias voltage Vzb without comprising an additional external voltage source and a switching device for applying voltage from the voltage source to the sustain electrodes so that it is possible to reduce expenses required for manufacturing the sustain driver circuit.

Figure 4B:
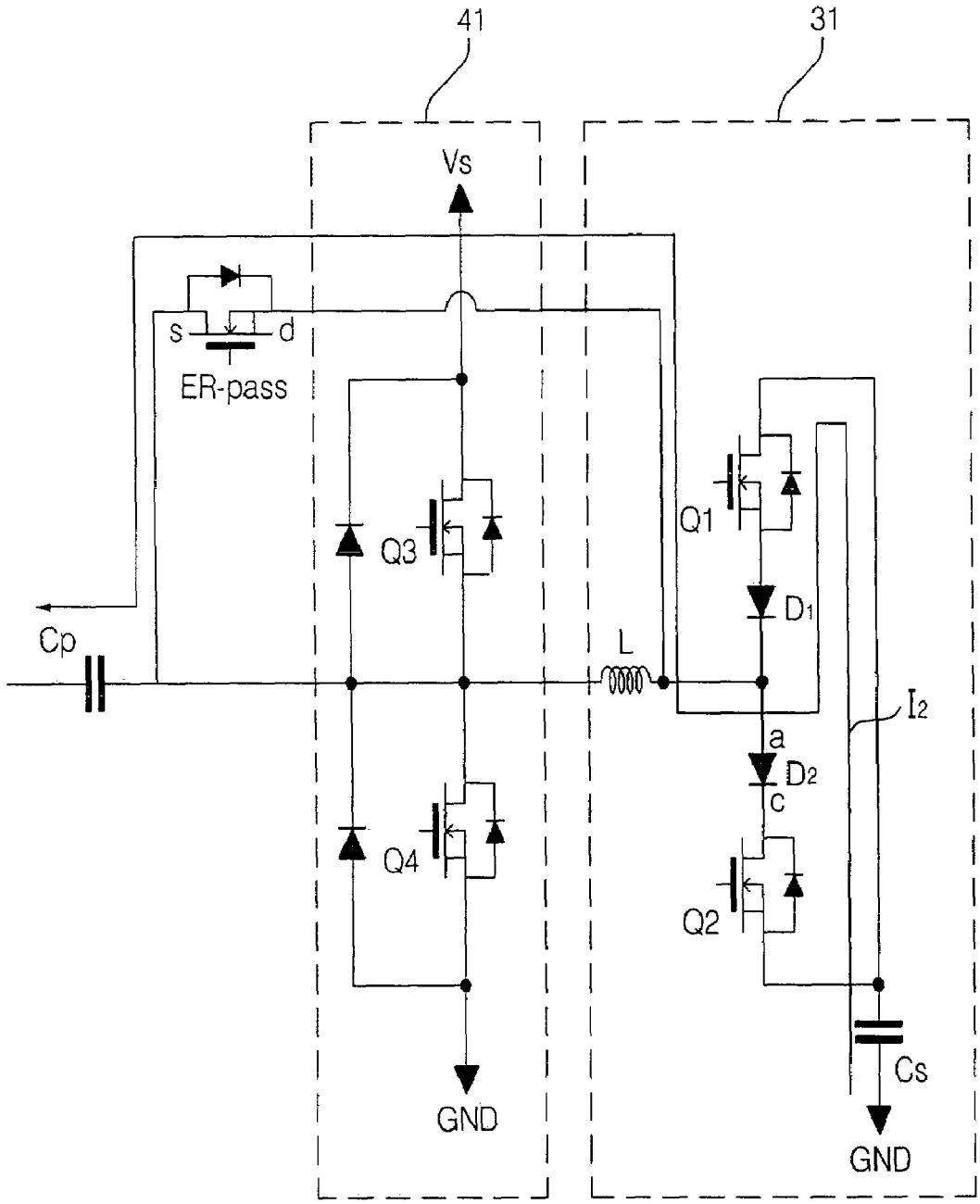
FIG. 4B illustrates a sustain driving circuit according to a second embodiment of the present invention.

A switching device is additionally connected to the circuit of the sustain driver according to the second embodiment illustrated in FIG. 4B in order to apply the bias voltage Vzb. Therefore, since the circuit of an energy recovery unit 31 and a sustain signal applying unit 41 according to the second embodiment are the same as the energy recovery unit 30 and the sustain signal applying unit 40 according to the first embodiment illustrated in FIG. 4A, detailed description thereof will be omitted.

In the circuit according to the second embodiment, the bias voltage is supplied to the panel capacitor Cp through a second current path I2 different from the first current path in which the voltage is recovered from the panel capacitor Cp by the energy recovery unit 31 in the sustain period S.

If the second current path I2 in which the bias voltage Vzb is supplied to the sustain driver is not additionally formed like in the first embodiment, the voltage stored in the source capacitor Cs passes through the inductor L and is applied to the sustain electrodes Z through the first current path I1.

At this time, since current flows through the inductor L, counter electromotive force is generated by the inductor L so that ripple is generated in the bias voltage Vzb. Therefore, the second current path I2 is formed like in the second embodiment and a path forming device ER_pass is connected to the second current path I2 so that it is possible to prevent the ripple from being generated in the bias voltage.

Therefore, when electricity flows through the path forming device ER_pass, the second current path I2 that connects the source capacitor Cs, the first switch Q1, and the path forming device ER_pass to each other is formed so that the voltage accumulated in the source capacitor Cs is applied to the panel capacitor Cp without passing through the inductor L. Therefore, more stable bias voltage Vzb is applied than in the first embodiment.

At this time, the path forming device ER_pass can be formed of a switching device such as a field effect transistor (FET) and an insulated gate bipolar transistor (IGBT) like the switch used for the energy recovery unit 31.

When the path forming device ER_pass is formed of the FET, the drain stage d of the FET switch is connected between the first and second switches Q1 and Q2 and the inductor L comprised in the energy recovery unit 31 and the source stage s of the FET switch is connected to the panel capacitor Cp.

Electricity flows through the first switch Q1 and the path forming device ER_pass of the above-described structure in the set-down period R_dn and in the address period A as illustrated in FIG. 5A so that the voltage stored in the source capacitor Cs is supplied to the bias voltage Vzb.

Also, electricity flows through the first switch Q1 and the path forming device ER_pass only in the address period A as illustrated in FIG. 5B so that the voltage stored in the source capacitor Cs is supplied to the bias voltage Vzb.

When electricity simultaneously flows through the first switch Q1 and the second switch Q2, in the case where the voltage stored in the source capacitor Cs is supplied as the bias voltage by the first switch Q1 and peak noise is instantaneously generated, the noise component is recovered to the source capacitor Cs by the second switch Q2 so that the stable bias voltage Vzb is applied to the sustain electrodes.

At this time, since the voltage recovered from the source capacitor Cs in the sustain period S is about half Vs/2 of the sustain voltage, the bias voltage applied to the sustain electrodes is about half Vs/2 of the sustain voltage.

The sustain driver according to the second embodiment illustrated in FIG. 4B can apply the bias voltage Vzb without comprising an additional external voltage source and can apply the stable bias voltage using the path forming device ER_pass.

According to the specification, the energy recovery units 30 and 31 according to a Weber circuit are used. However, energy recovery units according to another circuit may be used.

Since the present invention is characterized by the sustain driver for supplying the bias voltage Vzb and the sustain pulses to the sustain electrodes Z, the structure of the circuit of the scan electrodes Y and the waveforms of the driving signals applied to the scan electrodes Y are not limited to the drawings.

In FIG. 5A, the waveform of a reset signal is the same as the waveform of the reset signal described in a conventional art. However, in FIG. 5B, the waveform of a reset signal is composed of the waveform of a set-up signal R-up that ramp-rises in two stages and the waveform of a set-down signal R-dn that falls in four stages.

The waveform of the set-up signal R-up ramp-rises with a first slope and a second slope. The waveform of the set-down signal R-dn falls to the ground voltage source GND level and then, falls to the negative voltage level.

The reset signal is applied to the scan electrodes Y so that reset discharge is generated. Therefore, the wall charges formed in the scan electrodes Y and the sustain electrodes Z are erased so that a proper amount of wall charges that generate address discharge exist in a discharge cell.

Also, in FIG. 5B, a reset signal is applied before the reset signal is applied, which is referred to as a pre-reset signal R_pre. The waveform of the pre-reset signal R-pre ramp-falls from the ground voltage to the negative voltage. The negative voltage level may be the same as or different from the lowermost voltage level of the set-down signal R_dn.

In a pre-reset period where the pre-reset signal R_pre is applied, the pre-reset signal R_pre is supplied to the scan electrodes Y, a positive bias voltage Vzb' is applied to the sustain electrodes Z, and a voltage of a ground level is applied to the address electrodes X.

When the pre-reset signal R_pre is applied, weak discharge is generated between the scan electrodes Y and the sustain electrodes Z. Therefore, positive wall charges are formed in the scan electrodes Y and the address electrodes X and negative wall charges are formed in the sustain electrodes Z.

Since the pre-reset signal R_pre is applied so that a discharge cell is smoothly initialized through weak discharge, it is not necessary that the pre-reset signal R_pre be applied to all of the sub-fields that constitute one frame.

Therefore, the pre-reset signal R_pre may be applied before the reset signal every sub-field SF and may be applied to initial one to three sub-fields so that priming particles are generated.

According to a PDP of the present invention, a plurality of reset signals may be applied to one sub-field SF and waveform whose maximum voltage level varies may be applied every sub-field SF.

A method of driving a plasma display apparatus according to the present invention of the above structure comprises a first step of recovering a voltage from a PDP in the sustain period S and a second step of applying the recovered voltage as the bias voltage of the sustain electrodes in the address period A after the sustain period S, which will be described with reference to the timing diagrams of the first switch Q1, the second switch Q2, and the path forming device Q3 illustrated in FIGS. 5A and 5B.

At this time, since the bias voltage Vzb is actually the same as the voltage level recovered to the source capacitor Cs by the energy recovery units 30 and 31, the bias voltage Vzb is about half of the sustain voltage level.

In order to supply the voltage recovered in the sustain period S as the bias voltage Vzb of the sustain electrodes, electricity flows through the first switch Q1 of the energy recovery units 30 and 31 in the address period A.

Also, in order to supply the voltage recovered in the sustain period S as the bias voltage of the sustain electrodes, electricity simultaneously flows through the first switch Q1 and the second switch Q2 of the energy recovery units 30 and 31 in the address period A so that the ripple component generated by the inductor L can be removed.

If the sustain driver has the structure according to the second embodiment, electricity simultaneously flows through the first switch Q1 and the path forming device ER_pass of the energy recovery unit 31 in the address period A.

If the sustain driver has the structure according to the second embodiment, electricity simultaneously flows through the first switch Q1, the second switch Q2, and the path forming device ER_pass of the energy recovery unit 31 in the address period A so that the bias voltage Vzb is applied to the sustain electrodes.

The invention being thus described, it will be obvious that the same may be varied in many ways. Such variations are not to be regarded as a departure from the spirit and scope of the invention, and all such modifications as would be obvious to one skilled in the art are intended to be comprised within the scope of the following claims.

What is claimed is:

1. A plasma display apparatus comprising:

a plasma display panel having a plurality of electrodes; and a sustain driver applying a bias voltage to sustain electrodes in an address period, the bias voltage obtained from a voltage recovered from the plasma display panel in a sustain period that precedes the address period, wherein the sustain driver does not include an independent voltage source applying the bias voltage to the sustain electrodes.

2. The plasma display apparatus as claimed in claim 1, wherein the bias voltage applied by the sustain driver is approximately half of a sustain voltage applied by the sustain driver.

3. The plasma display apparatus as claimed in claim 1, wherein the sustain driver comprises:

a sustain signal applying unit for applying signals in a sustain period; and an energy recovery unit for recovering the voltage from the plasma display panel in the sustain period to apply the recovered voltage as the bias voltage in the address period.

4. The plasma display apparatus as claimed in claim 3, wherein the energy recovery unit comprises:

an inductor for forming LC resonance together with a panel capacitor in a sustain period;

a first switch for supplying a voltage recovered in the sustain period to the panel capacitor; and a second switch for recovering the voltage from the panel capacitor.

5. The plasma display apparatus as claimed in claim 4, wherein the energy recovery unit further comprises a source capacitor to store a voltage recovered by LC resonance.

6. The plasma display apparatus as claimed in claim 4, wherein the energy recovery unit makes electricity flow through the first switch in the address period so that the voltage recovered in the sustain period is supplied as the bias voltage.

7. The plasma display apparatus as claimed in claim 4, wherein the energy recovery unit makes electricity flow through the first switch and the second switch in the address period so that the voltage recovered in the sustain period is supplied as the bias voltage.

8. The plasma display apparatus as claimed in claim 3, wherein the sustain signal applying unit comprises:

a third switch for applying a sustain maximum electric potential; and a fourth switch for applying a sustain minimum electric potential.

9. The plasma display apparatus as claimed in claim 3, wherein a first path in which the voltage is recovered to the energy recovery unit in the sustain period is formed so that a second path in which the voltage recovered through the first path is supplied as the bias voltage in the address period is formed.

10. The plasma display apparatus as claimed in claim 9, further comprising a path forming device coupled to the second path to allow electricity to flow so that the bias voltage is applied to the sustain electrodes in the address period.

11. The plasma display apparatus as claimed in claim 10, wherein the path forming device is a field effect transistor switch having a source stage connected to the sustain electrodes and a drain stage connected to the energy recovery unit.

12. The plasma display apparatus as claimed in claim 9, wherein the second path is intercepted in a period other than the address period.

13. A plasma display apparatus comprising:

a plasma display panel having a plurality of electrodes; and a sustain driver including a path forming device for applying a bias voltage to sustain electrodes in an address period, the sustain driver obtaining the bias voltage based on a voltage recovered from the plasma display panel in a preceding sustain period.

14. The plasma display apparatus as claimed in claim 13, wherein the bias voltage is approximately half of a sustain voltage.

15. The plasma display apparatus as claimed in claim 13, wherein the path forming device is formed on a path in which the voltage recovered from the plasma display panel in the sustain period is supplied to the sustain electrode as the bias voltage in the address period.

16. The plasma display apparatus as claimed in claim 13, wherein electricity flows through the path forming device only in an address period.

17. A method of driving a plasma display apparatus, the method comprising:

(a) recovering a voltage from a plasma display panel in a sustain period; and (b) applying the recovered voltage as a bias voltage to sustain electrodes in an address period after the sustain period, wherein the plasma display apparatus applies the recovered voltage without including an independent voltage source applying the bias voltage to the sustain electrodes.

18. The method as claimed in claim 17, wherein the bias voltage is approximately half of a sustain voltage.

19. The method as claimed in claim 18, wherein in applying the recovered voltage electricity flows through a first switch of an energy recovery unit for supplying energy recovered in the sustain period to a panel capacitor.

20. The method as claimed in claim 18, wherein in applying the recovered voltage electricity flows through a first switch of an energy recovery unit for supplying energy recovered in a sustain period to the panel capacitor and a second switch of the energy recovery unit for recovering energy from the panel capacitor.

21. The plasma display apparatus as claimed in claim 1, wherein sustain driver is provided without an external voltage source for applying the bias voltage.

* * * * *